US007449822B2

(12) United States Patent
Yorita et al.

(10) Patent No.: US 7,449,822 B2
(45) Date of Patent: Nov. 11, 2008

(54) STRUCTURE OF SPARK PLUG ENSURING STABILITY IN LOCATION OF PRODUCTION OF SPARKS

(75) Inventors: Hiroshi Yorita, Kariya (JP); Shinichi Okabe, Aichi-ken (JP); Hitoshi Morita, Aichi-ken (JP); Tsunenobu Hori, Kariya (JP)

(73) Assignees: DENSO Corporation (JP); Nippon Soken, Inc. (JP)

( * ) Notice: Subject to any disclaimer, the term of this patent is extended or adjusted under 35 U.S.C. 154(b) by 351 days.

(21) Appl. No.: 10/910,585

(22) Filed: Aug. 4, 2004

(65) Prior Publication Data

US 2005/0029915 A1 Feb. 10, 2005

(30) Foreign Application Priority Data

Aug. 7, 2003 (JP) ..... 2003-288826

(51) Int. Cl.
*H01T 13/20* (2006.01)
*H01T 13/39* (2006.01)

(52) U.S. Cl. ..... 313/141; 313/142; 313/118; 123/169 EL; 123/169 R

(58) Field of Classification Search ..... None
See application file for complete search history.

(56) References Cited

U.S. PATENT DOCUMENTS 6,166,480 A * 12/2000 Ishida et al. ..... 313/141
6,470,845 B2 * 10/2002 Kanao ..... 123/169 EL
6,573,641 B2 * 6/2003 Matsutani ..... 313/141
6,603,246 B2 8/2003 Hori
6,653,767 B2 11/2003 Morita et al.
6,720,716 B2 4/2004 Shibata et al.

FOREIGN PATENT DOCUMENTS

| | | |
|---|---|---|
| JP | A-S57-138793 | 8/1982 |
| JP | UM-A-H03-024289 | 3/1991 |
| JP | A-2001-307857 | 2/2001 |
| JP | A-2001-319754 | 11/2001 |
| JP | 2002-184551 | 6/2002 |
| JP | 2002-324650 | 11/2002 |

OTHER PUBLICATIONS

Japanese Information Offer Form in counterpart Japanese Application No. 2003-288826 with English translation.
Japanese Office Action dated May 22, 2007 issued in counterpart Japanese Application No. 2003-288826 with English translation.

* cited by examiner

*Primary Examiner*—Sikha Roy
(74) *Attorney, Agent, or Firm*—Nixon & Vanderhye PC

(57) ABSTRACT

A small-sized spark plug is provided which ensures the stability in the location of production of sparks between center and ground electrodes. The center and ground electrodes have joined thereon cylindrical members such as noble metal chips which are opposed to each other through a spark gap. The cylindrical members are so oriented to have longitudinal center lines extend parallel in misalignment with each other. This orientation results in shorter and longer intervals between end surfaces of the cylindrical members. The sparks are concentrated between portions of edges of cylindrical members located apart the shorter interval, thereby resulting in the stability in the location of production of the sparks.

15 Claims, 13 Drawing Sheets

STRUCTURE OF SPARK PLUG ENSURING STABILITY IN LOCATION OF PRODUCTION OF SPARKS

BACKGROUND OF THE INVENTION

1. Technical Field of the Invention

The present invention relates generally to an improved structure of a spark plug suitable for downsizing, and more particularly to such a spark plug designed to ensure the stability in location of production of sparks between a center and a ground electrode.

2. Background Art

Typical spark plugs for automotive engines or gas engines are equipped with a center electrode and a ground electrode. The center electrode is disposed within a metal shell and has a tip exposed outside the metal shell. The ground electrode is joined at one end thereof to the metal shell and bent to have the other end thereof face the center electrode through a spark gap.

U.S. Pat. No. 6,653,767 B2 to Morita et al., assigned to the same assignee as that of this application, discloses a small-sized spark plug equipped with cylindrical chips joined to center and ground electrodes. The cylindrical chips have end surfaces which are opposed to each other through a spark gap. Each of the cylindrical chips has a diameter of is 1.1 mm or less, namely, a cross sectional area of 0.95 $mm^2$. The spark plug has the decreased spark gap, however, is designed to ensure the ignitability of fuel without sacrificing the growth of flame kernel within the engine.

The inventors of this application have analyzed the structure of spark plugs suitable for downsizing and found problems, as discussed below.

FIG. 19 is a partial side view which shows an example of a spark plug of the type as described above.

The center electrode 30 is disposed within the metal shell 10 with the tip 31 exposed outside the metal shell 10. The ground electrode 40 is welded at an end 42 to the metal shell 10 and opposed at an end 41 to the tip 31 of the center electrode 30.

The cylindrical chips 35 and 45 are joined to spark gap-facing portions 31 and 43 of the center and ground electrodes 30 and 40. The cylindrical chips 35 and 45 have end surfaces 35*a* and 45*a* opposed to each other through the spark gap 50.

Each of the cylindrical chips 35 and 45 is made of, for example, Ir (Iridium) or Pt (Platinum). The cylindrical chips 35 and 45 are located to have longitudinal center lines 35*b* and 45*b* aligned with each other.

Application of voltage across the center and ground electrodes 30 and 40 will result in an increased strength of electric field at corners or edges of the cylindrical chips 35 and 45. This causes sparks to appear, as indicated by arrows in FIGS. 19 and 10, between edges of the end surfaces 35*a* and 45*a* of the cylindrical chips 35 and 45, not flat portions thereof.

The inventors have found that such sparks are produced at random on different locations of the edges of the end surfaces 35*a* and 45*a*, thus resulting in a variation in velocity of combustion between combustion cycles.

A portion P6 of the edge of the end surface 45*a* of the cylindrical chip 45 of the ground electrode 40 close to the bend 44 is an area from which much thermal energy is withdrawn to the metal shell 10, so that the temperature thereof is kept lower, while a portion P10 of the edge of the end surface 45*a* of the cylindrical chip 45 close to the tip 41 is an area from which less thermal energy is withdrawn to the metal shell 10, so that the temperature thereof is kept higher.

Therefore, when sparks are produced on the portion P10 of the end surface 45*a* of the cylindrical chip 45 close to the tip 41, it will results in quick growth of flame kernel in the engine and increased velocity of combustion. Conversely, when sparks are produced on the portion P6 of the end surface 45*a* close to the bend 44, it will result in slow growth of flame kernel and decreased velocity of combustion.

Specifically, conventional spark plugs of the type, as described above, are subjected to a variation in velocity of combustion between combustion cycles of, for example, automotive spark ignition engines. This results in a variation in amount of thermal energy produced between the combustion cycles, which leads to mechanical vibrations of the engine.

SUMMARY OF THE INVENTION

It is therefore a principal object of the invention to avoid the disadvantages of the prior art.

It is another object of the invention to provide a small-sized structure of a spark plug designed to ensure the stability in the location of production of sparks between center and ground electrodes.

According to one aspect of the invention, there is provided an improved structure of a spark plug which may be employed in automotive engines. The spark plug comprises: (a) a metal shell; (b) a center electrode disposed within the metal shell with a top projecting from the metal shell, the top having a ground electrode-facing portion on which a cylindrical member is joined; and (c) a ground electrode having a first end portion and a second end portion opposed to the first end portion. The first end portion is joined to the metal shell. The second end portion has a center electrode-facing portion to which a cylindrical member is joined. The cylindrical member of the center electrode extends toward the center electrode-facing portion of the ground electrode to have an end surface facing the center electrode-facing portion. The cylindrical member of the ground electrode extends toward the ground electrode-facing portion of the center electrode to have an end surface facing the end surface of the cylindrical member of the center electrode through a spark gap. The diameters of the cylindrical members of the center and ground electrodes are 1.1 mm or less. A longitudinal center line of the cylindrical member of the center electrode extends parallel to a longitudinal center line of the cylindrical member of the ground electrode in misalignment with each other. The amount of misalignment between the longitudinal center lines of the cylindrical members is 0.05 mm or more and less than or equal to the greater of radiuses of the cylindrical members.

Specifically, the diameters of the cylindrical members of the center and ground electrodes are, as described above, determined to be 1.1 mm or less in order to decrease the overall size of the spark plug. Typical spark plugs of such a small-sized type have cylindrical members of center and ground electrodes whose longitudinal center lines are aligned with each other. In contrast, the spark plug of this invention has the longitudinal center lines of the cylindrical members of the center and ground electrodes extend parallel in misalignment with each other. Such a positional relation results in shorter and longer intervals between the end surfaces of the cylindrical members of the center and ground electrodes. A sequence of sparks are, therefore, concentrated between portions of the end surfaces of the cylindrical members spaced apart at the shorter interval. In other words, the possibility that the sparks are produced will be high between the portions of the end surfaces located far away at the shorter interval. This results in the stability in the location of production of sparks between the center and ground electrodes within the spark gap. Further, the amount of misalignment between the longitudinal center lines of the cylindrical members is 0.05 mm or more. The inventors of this application have found that such misalignment increases the stability in the location of production of sparks, as will be described later in detail with reference to FIG. 5. Additionally, the misalignment is less than or equal to half the greater of radiuses of the cylindrical members. The inventors have also found that such a numeral limitation minimizes the wear of edges of the cylindrical members of the center and ground electrodes.

In the preferred mode of the invention, a difference between the diameters of the cylindrical members of the center and ground electrodes is greater than or equal to twice the amount of misalignment between the longitudinal center lines of the cylindrical members of the center and ground electrodes. This causes the shortest interval to be created between portions of edges of the cylindrical members of the center and ground electrodes which are located close to each other. The inventors have found that the possibility of production of sparks will be high between such close portions of the cylindrical members.

The end surfaces of the cylindrical members of the center and ground electrodes may extend parallel to each other.

The degree of parallelism between the end surfaces of the cylindrical members of the center and ground electrodes may be greater than or equal to 1% of the spark gap. This causes a difference between maximum and minimum intervals between the end surfaces of the cylindrical members to be 1% of the spark gap. The inventors have found experimentally that such a structure results in the stability in the location of production of sparks.

The degree of parallelism is less than 0.15 mm.

One of the longitudinal center lines of the cylindrical members of the center and ground electrodes may be shifted to the other in a direction in which portions of the end surfaces of the cylindrical members of the center and ground electrodes located apart from each other at the shortest interval exhibits the highest possibility of production of sparks therebetween.

The ground electrode may be made of a bar member which has a middle portion between the first and second end portions. The middle portion is bent to have the second end portion extend over the top of the center electrode.

The cylindrical members of the center and ground electrodes may be implemented by noble metal chips welded to materials of the center and ground electrodes, respectively.

Each of the noble metal chips of the center electrode and the ground electrode may be made of one of an Ir alloy containing 50 Wt % or more of Ir and a Pt alloy containing 50 Wt % of Pt.

Each of the noble metal chips of the center electrode and the ground electrode may be made of a material containing, as an additive, one of Ir, Pt, Rh, Ni, W, Pd, Ru, Os, Al, Y, and $Y_2O_3$.

According to the second aspect of the invention, there is provided a spark plug which comprises: (a) a metal shell; (b) a center electrode disposed within the metal shell with a top projecting from the metal shell, the top having a ground electrode-facing portion on which a cylindrical member is joined; and (c) a ground electrode having a first end portion and a second end portion opposed to the first end portion. The first end portion is joined to the metal shell. The second end portion has a center electrode-facing portion to which a cylindrical member is joined. The cylindrical member of the center electrode extends toward the center electrode-facing portion of the ground electrode to have an end surface facing the center electrode-facing portion. The cylindrical member of the ground electrode extends toward the ground electrode-facing portion of the center electrode to have an end surface facing the end surface of the cylindrical member of the center electrode through a spark gap. The diameters of the cylindrical members of the center and ground electrodes are 1.1 mm or less. The degree of parallelism between the end surfaces of the cylindrical members of the center and ground electrodes is greater than or equal to 1% of the spark gap and less than 0.15 mm.

The above structure, like the first aspect invention, ensures the stability in the location of production sparks between the center and ground electrodes.

In the preferred mode of the invention, a longitudinal center line of the cylindrical member of the center electrode extends parallel to a longitudinal center line of the cylindrical member of the ground electrode.

The longitudinal center line of the cylindrical member of the center electrode may alternatively extend unparallel to a longitudinal center line of the cylindrical member of the ground electrode.

The ground electrode is made of a bar member which has a middle portion between the first and second end portions. The middle portion is bent to have the second end portion extend over the top of the center electrode so that an interval between a portion of the end surface of the cylindrical member of the ground electrode close to a tip of the second end portion and the end surface of the center electrode is smaller than an interval between a portion of the end surface of the cylindrical member of the ground electrode close to the middle portion and the end surface of the center electrode.

The cylindrical members of the center and ground electrodes may be implemented by noble metal chips welded to materials of the center and ground electrodes, respectively.

Each of the noble metal chips of the center electrode and the ground electrode may be made of one of an Ir alloy containing 50 Wt % or more of Ir and a Pt alloy containing 50 Wt % of Pt.

Each of the noble metal chips of the center electrode and the ground electrode may be made of a material containing, as an additive, one of Ir, Pt, Rh, Ni, W, Pd, Ru, Os, Al, Y, and $Y_2O_3$.

According to the third aspect of the invention, there is provided a spark plug which comprises: (a) a metal shell; (b) a center electrode disposed within the metal shell with a top projecting from the metal shell, the top having a ground electrode-facing portion on which a cylindrical member is joined; and (c) a ground electrode having a first end portion and a second end portion opposed to the first end portion. The first end portion is joined to the metal shell. The second end portion has a center electrode-facing portion to which a cylindrical member is joined. The cylindrical member of the center electrode extends toward the center electrode-facing portion of the ground electrode to have an end surface facing the center electrode-facing portion. The cylindrical member of the ground electrode extends toward the ground electrode-facing portion of the center electrode to have an end surface facing the end surface of the cylindrical member of the center electrode through a spark gap. The diameters of the cylindrical members of the center and ground electrodes are 1.1 mm or less. A longitudinal center line of the cylindrical member of the center electrode extends parallel to a longitudinal center line of the cylindrical member of the ground electrode in misalignment with each other.

This structure, like the first aspect invention, result in shorter and longer intervals between the end surfaces of the cylindrical members of the center and ground electrodes, thus causing a sequence of sparks to be concentrated between portions of edges of the cylindrical members located far away at the shorter interval. This ensures the stability in the location of production of sparks.

BRIEF DESPCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 3(*b*) is an illustration, as viewed from a longitudinal direction in FIG. 3(*a*), which shows a spatial overlap between the tips of the center and ground electrodes;

FIG. 4(*b*) is an illustration, as viewed from a longitudinal direction in FIG. 4(*a*), which shows a spatial overlap between the tips of the center and ground electrodes;

FIG. 15(*b*) is a top view which shows another modified form of a spark plug of the first embodiment;

FIG. 18(*b*) is a partially side illustration, as viewed from the right in FIG. 18(*a*);

DESCRIPTION OF THE PREFERRED EMBODIMENTS

Figure 1:
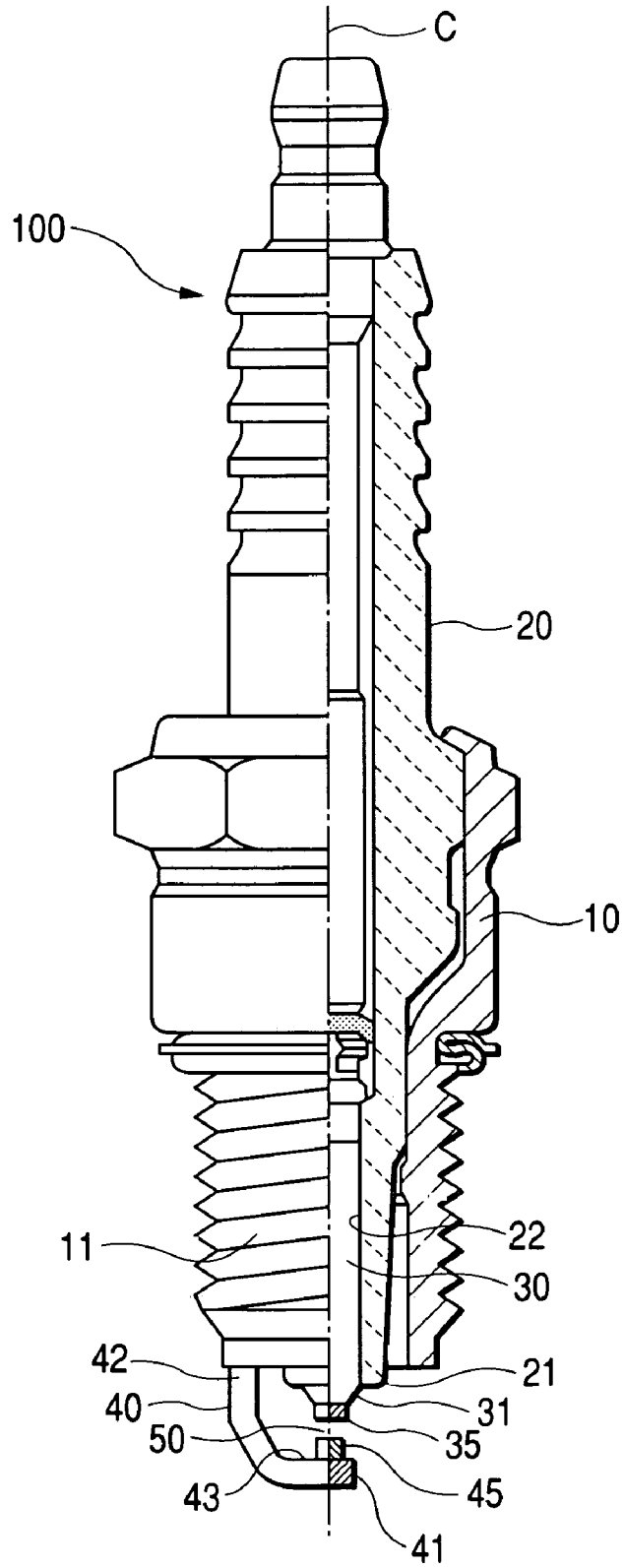
FIG. 1 is a partially sectional view which shows a spark plug according to the first embodiment of the invention.

Referring to the drawings, wherein like reference numbers refer to like parts in several views, particularly to FIG. 1, there is shown a spark plug 100 which may be used in internal combustion engines for automotive vehicles.

The spark plug 100 includes a hollow cylindrical metal shell (i.e., housing) 10, a porcelain insulator 20, a center electrode 30, and a ground electrode 40. The metal shell 10 is made of a conductive iron steel such as a low carbon steel and has cut therein a thread 11 for mounting the spark plug 100 in a plug hole of an engine head defining combustion chambers of the internal combustion engine. The metal shell 10 is machined into a cylindrical shape by cold forging and cutting.

The porcelain insulator 20 made of an alumina ceramic ($Al_2O_3$) is retained within the metal shell 10 and has a tip 21 exposed outside the metal shell 10.

The center electrode 30 is secured in a central chamber 22 of the porcelain insulator 20 and insulated electrically from the metal shell 10. The center electrode 30 extends in alignment with a longitudinal center line C of the spark plug 100 (i.e., a longitudinal center line of the metal shell 10) and has a tip 31 projecting from the tip 21 of the porcelain insulator 20. The center electrode 30 is formed by a cylindrical member which is made up of a core portion made of a metallic material such as Cu having a higher thermal conductivity and an external portion made of a metallic material such as a Ni-based alloy having higher thermal and corrosion resistances.

Figure 2:
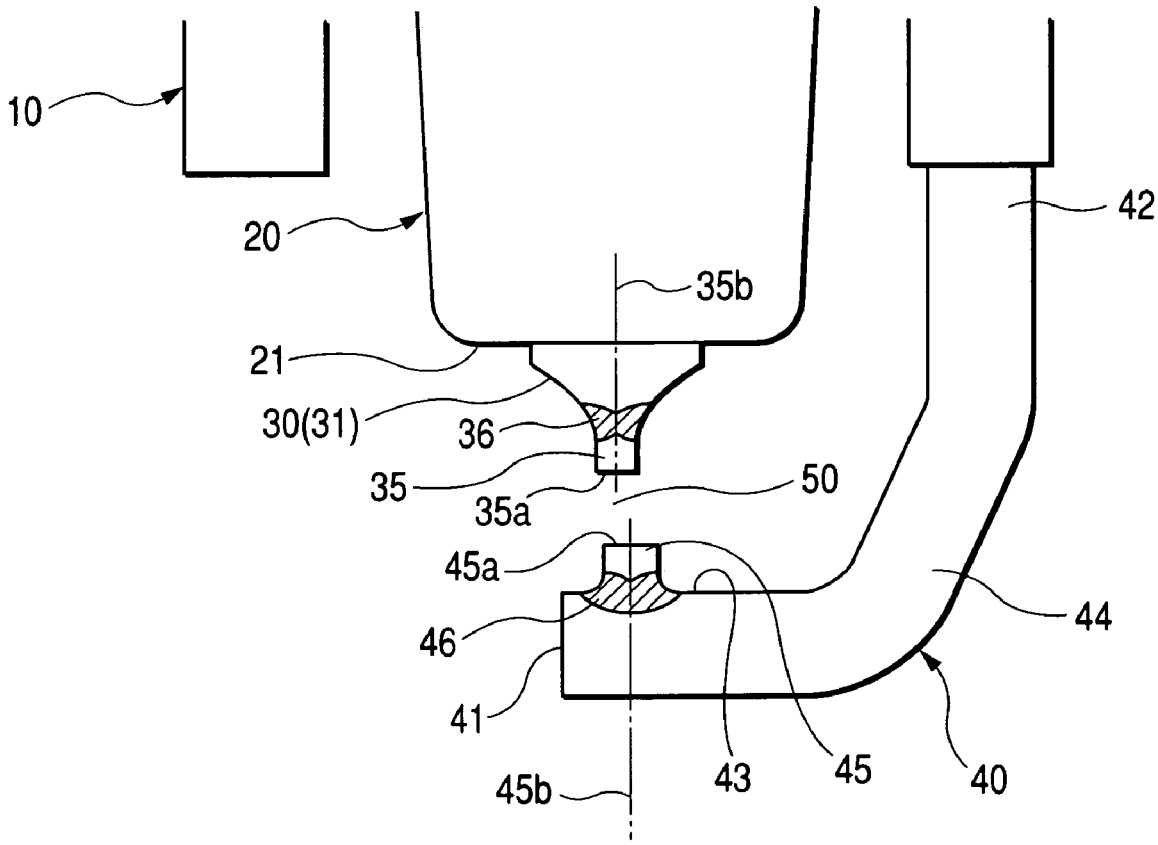
FIG. 2 is an enlarged view which shows tips of a ground and a center electrode of the spark plug of FIG. 1.

The ground electrode 40 is made up of a tip 41, a base 42, and a middle portion 44 extending, as clearly shown in FIG. 2, between the tip 41 and the base 42. The middle portion 44 is bent horizontally to have the tip 41 face the tip 31 of the center electrode 30. The middle portion 44 will also be referred to as a bend below.

The ground electrode 40 is formed by a bar such as a prismatic pole made of a Ni alloy whose main component is nickel and welded at the base 42 directly to an end of the metal shell 10. The ground electrode 40 (i.e., the middle portion 44) is, as clearly shown in FIG. 2, bent to an L-shape to have an inner side surface 43 face the tip 31 of the center electrode 30 through a spark gap 50.

Cylindrical chips 35 and 45 are joined by laser welding to an end surface of the tip 31 of the center electrode 30 and the inner side surface 43 of the ground electrode 40, respectively. The chips 35 and 45 have, as clearly shown in FIG. 3(*a*), end surfaces 35*a* and 45*a* opposed to each other through the spark gap 50.

The chips 35 and 45 may be made of same materials as those of the center electrode 30 and the ground electrode 40 and formed integrally therewith.

The chips 35 and 45 may be joined at ends thereof opposite the end surfaces 35*a* and 45*a* to the center electrode 30 and the ground electrode 40 by laser welding, resistance welding, arc welding, or plasma welding. The laser welding is preferable in terms of joint strength. In this embodiment, the chips 35 and 45 are laser-welded to the center and ground electrodes 30 and 40 to form, as shown in FIG. 2, fused portions 36 and 46 (i.e., weld nuggets) at interfaces therebetween, respectively. The fused portions 36 are each formed by materials of the center electrode 30 and the chip 35 melted together. Similarly, the fused portions 46 are each formed by materials of the ground electrode 40 and the chip 45 melted together.

Each of the chips 35 and 45 of the center and ground electrodes 30 and 40 may be made of a noble metal such as Pt, Pt alloy containing 50 wt % of Pt or more, Ir, or Ir alloy containing 50 wt % of Ir or more. In this embodiment, the chip 35 is made of the Ir alloy. The chip 45 is made of the Pt alloy. Such alloys may contain an additive of at least one of Ir (iridium), Pt (platinum), Rh (rhodium), Ni (nickel), W (tungsten), Pd (palladium), Ru (ruthenium), Os (osmium), Al (aluminum), Y (yttrium), and $Y_2O_3$ (diyttrium trioxide or yttria).

The end surface 35*a* of the center electrode 30 extends substantially parallel to the end surface 45*a* of the ground electrode 40 to define the spark gap 50 therebetween. The size of the spark gap 50, that is, a minimum interval G between the end surfaces 35*a* and 45*a*, as shown in FIG. 3(*a*), is 1 mm.

Figure 3A:
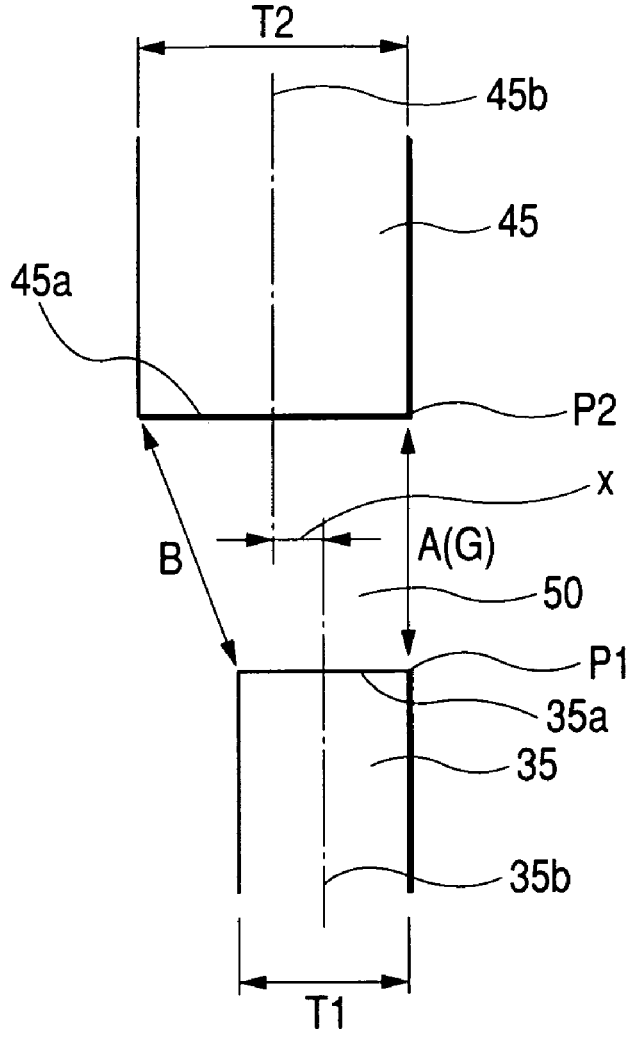
FIG. 3(*a*) is a side view which shows a locational relation between tips of a center electrode and a ground electrode of the spark plug of FIG. 1.
Figure 3B:
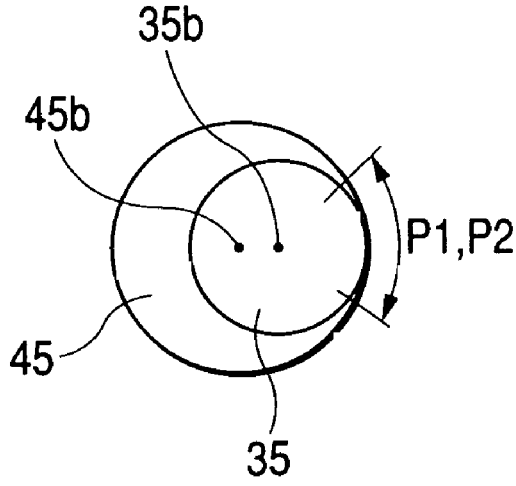

The noble metal chips 35 and 45 have, as shown in FIG. 3(*a*), diameters T1 and T2 each of which is 1.1 mm or less.

The diameters T1 and T2 of the noble metal chips 35 and 45, as referred to herein, are diameters of the end surfaces 35*a* and 45*a*. When the diameters T1 and 72 are 1.1 mm or less, an area of each of the end surfaces 35*a* and 45*a* will be 0.95 $mm^2$ or less.

The noble metal chips 35 and 45 have lengths projecting from the tip 31 and the inner side surface 43 which are approximately 0.8 mm, although not limited thereto.

The noble metal chips 35 and 45 are, as can be seen from FIGS. 3(*a*) and 3(*b*), extend in misalignment with each other. Specifically, a longitudinal center line 35*b* of the noble metal chip 35 of the center electrode 30 extends parallel to and is shifted from a longitudinal center line 45*b* of the noble metal chip 45 of the ground electrode 40 in a radius direction of the noble metal chips 35 and 45.

The amount of misalignment x between the longitudinal center lines 35*b* of the noble metal chip 35 and the center line 45*b* of the noble metal chip 45 (i.e., an interval between the lines 35*b* and 45*b*) is 0.05 mm or more that is less than or equal to the greater of radiuses of the noble metal chips 35 and 45. The amount of misalignment x will also be referred to as an axis misalignment below.

The diameters T1 and T2 of the noble metal chips 35 and 45 may be equal to or different from each other.

When the diameters T1 and T2 of the noble metal chips 35 and 45 are equal to each other, the axis misalignment x is less than or equal to 0.5 T1 and 0.5 T2.

Alternatively, when the diameters T1 and T2 of the noble metal chips 35 and 45 are different from each other, the axis misalignment x is less than or equal to the greater of radiuses of the noble metal chips 35 and 45. In other words, a difference between the diameters T1 and T2 of the noble metal chips 35 and 45 is greater than twice the axis misalignment x.

As apparent from the above discussion, the feature of the spark plug 100 of this embodiment is that the axis misalignment x is 0.05 mm or more which is less than or equal to the greater of radiuses of the noble metal chips 35 and 45. The basis for this will be described below.

Figure 19:
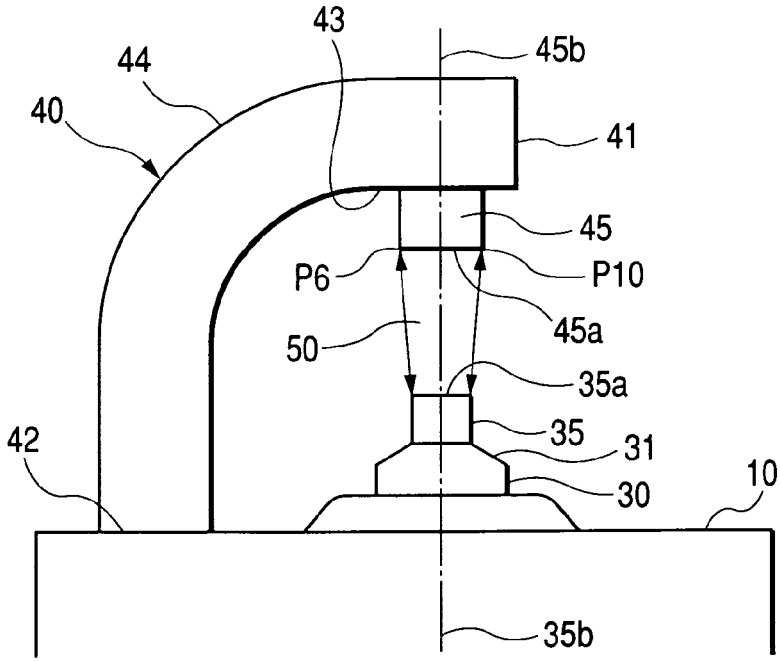
FIG. 19 (PRIOR ART)
FIG. 19 is a partial side view which shows a conventional spark plug.
Figure 20:
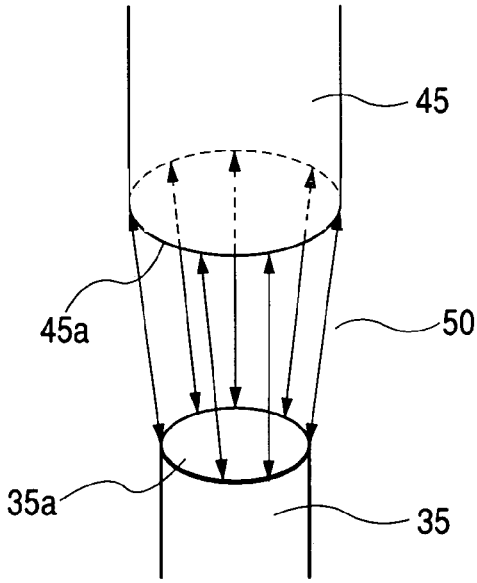
FIG. 20 (PRIOR ART)
FIG. 20 is a perspective view which shows a locational relation between cylindrical chips on center and ground electrode of the spark plug of FIG. 19.

The conventional spark plug, as illustrated in FIG. 19, has the cylindrical chips 35 and 45 joined to the center and ground electrodes 30 and 40 which are aligned to have the end surfaces 35*a* and 45*a* face each other through the spark gap 50. The diameters T1 and T2 of the chips 35 and 45 are both set to 1.1 mm or less in order to decrease the size of the spark plug. The longitudinal center lines 35*b* and 45*b* of the chips 35 and 45 extend in alignment with each other.

The spark plug 100 of this embodiment has the longitudinal center lines 35*b* and 45*b* of the noble metal chips 35 and 45 extending in misalignment with each other. The misalignment results, as can be seen from FIGS. 3(*a*) and 3(*b*), in a variation in interval between an edge of the end surface 35*a* of the noble metal chip 35 and an edge of the end surface 45*a* of the noble metal chip 45. Specifically, a smaller interval A and a greater interval B are created between the edges of the end surfaces 35*a* and 45*a* of the noble metal chips 35 and 45.

The smaller interval A, as can be seen from FIG. 3(*b*), occupies a range, as indicated by P1 and P2, of approximately one-fourth (¼) of the circumference of the noble metal chip 35.

The diameter T2 of the noble metal chip 45 of the ground electrode 40 is, as clearly shown in FIGS. 3(*a*) and 3(*b*), greater than the diameter T2 of the noble metal chip 35 of the center electrode 30, in other words, the noble metal chip 45 is thicker than the noble metal chip 35.

The fact that the smaller interval A and the greater interval B are created between the edges of the end surfaces 35*a* and 45*a* of the noble metal chips 35 and 45 is true for the case where the diameters T1 and T2 of the noble metal chips 35 and 45 are identical with each other.

Figure 4A:
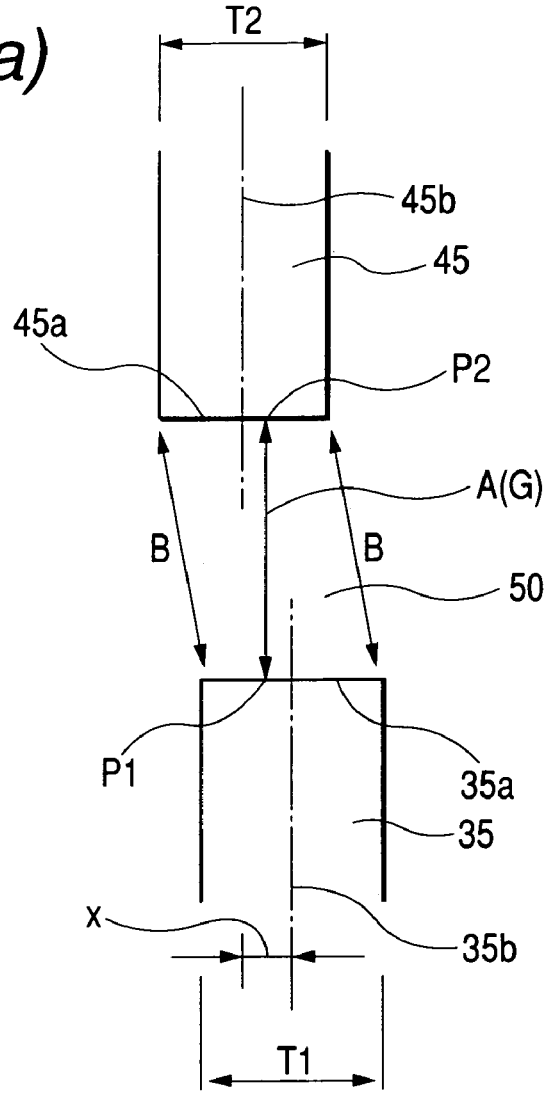
FIG. 4(*a*) is a side view which shows a locational relation between tips of a center electrode and a ground electrode of a modification of the spark plug of FIG. 1 which are identical in diameter with each other.
Figure 4B:
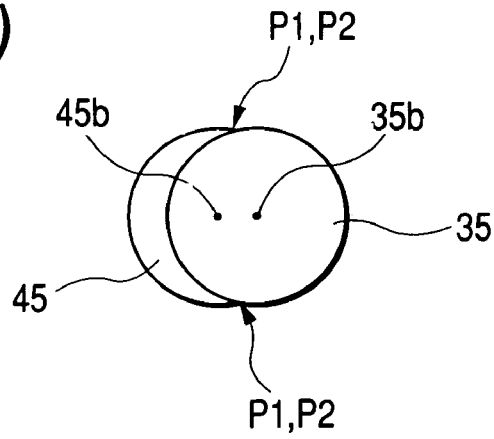

FIGS. 4(*a*) and 4(*b*) illustrate a modification of the spark plug 100 in which the diameters T1 and T2 of the noble metal chips 35 and 45 are identical with each other, and the longitudinal center lines 35*b* and 45*b* of the noble metal chips 35 and 45 are misaligned with each other. The smaller interval A, like the one in FIG. 3(*b*), occupies a range of approximately one-fourth (¼) of the circumference of each of the noble metal chips 35 and 45.

Specifically, the misalignment between the longitudinal center lines 35*b* and 45*b* of the noble metal chips 35 and 45 results in a variation in interval between the edges of the end surfaces 35*a* and 45*a*. This results in an increased possibility that a sequence of sparks will be created between portions P1 and P2 of the edges of the end surfaces 35*a* and 45*a* spaced from each other at the smaller interval A whether the diameters T1 and T2 of the noble metal chips 35 and 45 are identical with each other or not.

The conventional spark plug creates a sequence of sparks between the edges of the noble metal chips 35 and 45 at random, however, the spark plug 100 of this embodiment works to concentrate the sparks in between the portions P1 and P2 of the edges of the end surfaces 35*a* and 45*a* located far from each other at the smaller interval A, thus ensuring the stability in the location of the sparks between the noble metal chips 35 and 45.

The misalignment between the longitudinal center lines 35*b* and 45*b* of the noble metal chips 35 and 45 in the case where the noble metal chips 35 and 45 are different in diameter results in a greater difference between the intervals A and B than the case where the noble metal chips 35 and 45 are identical in diameter.

We performed researches on the relation between the axis misalignment x and the stability in producing the sparks.

We prepared samples of the spark plug 100 in which the diameters T1 and T2 of the noble metal chips 35 and 45 were, like the one of FIGS. 4(*a*) and 4(*b*), equal to each other, which were 0.6 mm. The spark plug samples included two types: the first in which the longitudinal center lines 35*b* and 45*b* of the noble metal chips 35 and 45 were aligned with each other and the second in which the axis misalignment x between the longitudinal center lines 35*b* and 45*b* was 0.05 mm. In the first type samples, the percentage of sparks produced between the portions P1 and P2 of the edges of the end surfaces 35*a* and 45*a* spaced from each other at the smaller interval A was 50%. The sparks were created at two locations, as shown in FIG. 4(*b*), diametrically opposed to each other. The percentage of the sparks created at each of the locations was, thus, 25%.

In the second type samples in which the axis misalignment x between the longitudinal center lines 35*b* and 45*b* was 0.05 mm, the percentage of sparks created between the portions P1 and P2 of the edges of the end surfaces 35*a* and 45*a* at two locations was 80%. Such a percentage at each of the two locations was 40%.

We also prepared samples of the spark plug 100 in which the diameter T2 of the noble metal chip 45 was, like the one of FIGS. 3(*a*) and 3(*b*), greater than the diameter T1 of the noble metal chip 35 and measured the relation of each sample between the axis misalignment x and the percentage of sparks between the portions P1 and P2 of the edges of the end surfaces 35*a* and 45*a* spaced at the smaller interval A as a portion of sparks created between the entire edges of the end surfaces 35*a* and 45*a*. The measured relations are shown in a graph of FIG. 5. The samples included three types: first in which the diameter T1 of the noble metal chip 35 was 0.6 mm, and the diameter of the noble metal chip 45 was 0.7 mm, the second in which the diameter T1 of the noble metal chip 35 was 0.6 mm, and the diameter of the noble metal chip 45 was 0.8 mm, and the third in which the diameter TI of the noble metal chip 35 was 0.6 mm, and the diameter of the noble metal chip 45 was 0.9 mm. "□" indicates the first samples. "○" indicates the second samples. "Δ" indicates the third samples.

Figure 5:
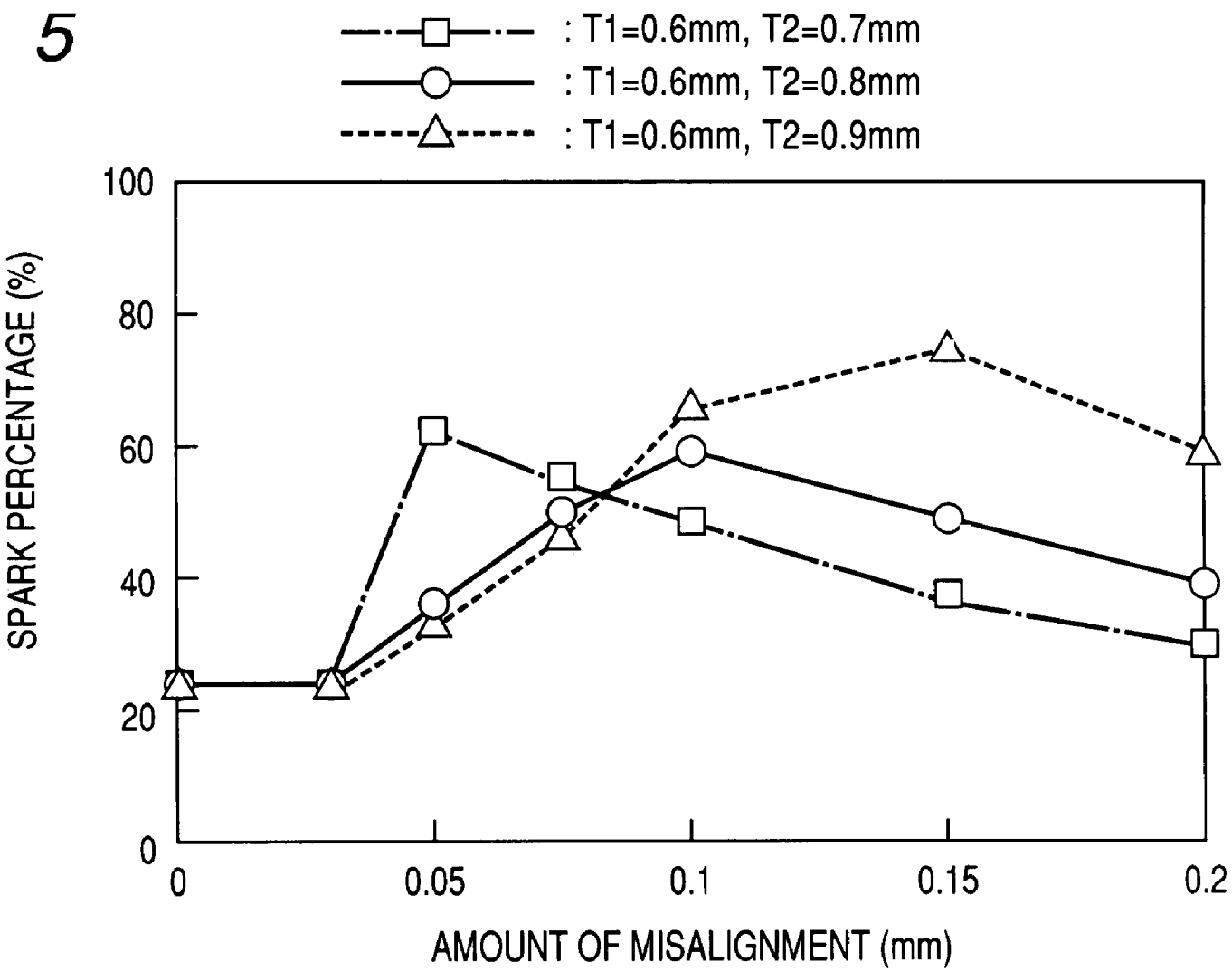
FIG. 5 is a graph which shows a relation between the amount of misalignment between longitudinal center lines of cylindrical chips on a center and a ground electrode and the percentage of production of sparks within a shorter interval between the cylindrical chips.

The graph of FIG. 5 shows that when the axis misalignment x is 0.05 mm or more, the percentage of sparks produced between the portions P1 and P2 of the edges of the end surfaces 35*a* and 45*a* spaced at the smaller interval A increases desirably, that is, many sparks are produced between the portions P1 and P2.

The first, second, and third type samples have differences between the diameters T1 and T2 of the noble metal chips 35 and 45 that are 0.1 mm, 0.2 mm, and 0.3 mm, respectively. The graph also shows that the highest percentage of sparks created between the portions P1 and P2 of the edges of the end surfaces 35*a* and 45*a* spaced at the smaller interval A appears when the axis misalignment x is 0.05 mm in the first type samples, when the axis misalignment x is 0.1 mm in the second type sample, and when the axis misalignment x is 0.15 mm in the third type samples.

Specifically, it is found that when the difference between the diameters T1 and T2 is twice the axis misalignment x, sparks are concentrated between the portions P1 and P2 of the edges of the end surfaces 35*a* and 45*a* in each of the first, second, and third type samples. Accordingly, in the case where the noble metal ships 35 and 45 are used which are different in diameter from each other, the spark plug 100 is so designed that a difference between the diameters T1 and T2 is greater than or equal to twice the axis misalignment x.

The reason why the axis misalignment x is less than or equal to the greater of radiuses of the noble metal chips 35 and 45 will be described below.

The case where the axis misalignment x is greater than the greater of radiuses of the noble metal chips 35 and 45 will first be discussed.

Figure 6:
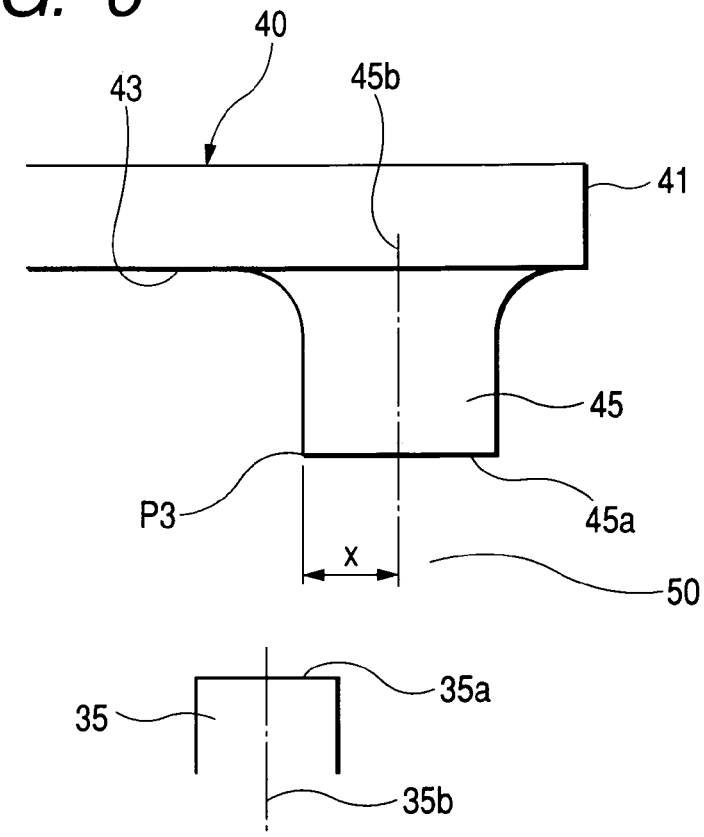
FIG. 6 is a partial side view which shows a comparative example in which the amount of misalignment between longitudinal center lines of cylindrical chips on center and ground electrodes is greater than half the greater of radiuses of the cylindrical chips.

FIG. 6 illustrates a park plug in which the noble metal chip 45 of the ground electrode 40 is, like the one in FIGS. 3(*a*) and 3(*b*), thicker than the noble metal chip 35 of the center electrode 30, and the axis misalignment x between the longitudinal center lines 35*b* and 45*b* of the noble metal chips 35 and 45 is greater than the radius (i.e., half the diameter T2) of the thicker noble metal chip 45. The fused portions 46 are omitted in the drawing for the brevity of illustration.

We have found that in the spark plug of the type as illustrated, sparks are, in practice, created between only portions of the edges of the end surfaces 35*a* and 45*a* apart from each other at an interval decreased by the misalignment between the longitudinal center lines 35*b* and 45*b* of the noble metal chips 35 and 45. Specifically, the sparks appear only at a portion P3 of the edge of the end surface 45*a* of the noble metal chip 45. This causes the portion P3 to undergo a greater degree of wear than another portion of the edge of the end surfaced 45*a*. Thus, the portion P3 will get worn fast, which results in a decreased service life of the spark plug.

The presence of too great a misalignment between the longitudinal center lines 35*b* and 45*b* of the noble metal chips 35 and 45 results in decreased areas of the end surfaces 35*a* and 45*a* overlapping spatially with each other.

When areas of the end surfaces 35*a* and 45*a* which do not overlap spatially with each other in the longitudinal direction of the noble metal chips 35 and 45 increase, it would cause sparks to be produced between portions of the noble metal chips 35 and 45 other than the end surfaces 35*a* and 45*a*. The sparks may appear on the fused portions 36 and 46, as illustrated in FIG. 2, of the noble metal chips 35 and 45, so that the fused portions 36 and 46 get worn greatly.

It is, thus, advisable in terms of the service life, as described above, that the axis misalignment x be less than or equal to the greater of radiuses of the noble metal chips 35 and 45.

For the reasons, as described above, the spark plug 100 of this embodiment is so designed that the axis misalignment x is 0.05 mm or more and less than or equal to the greater of radiuses of the noble metal chips 35 and 45. This ensures the stability in the locations of the sparks developed between the noble metal chips 35 and 45.

The ground electrode 40 is made of a bar such as a prismatic pole made and has the bend 44 to have the tip 41 extending over the tip 31 of the center electrode 30. This structure facilitates ease of orientation in which the longitudinal center lines 35*b* and 45*b* of the noble metal chips 35 and 45 extend parallel in misalignment with each other.

The longitudinal center lines 35*b* and 45*b* may be shifted in any directions. For example, when the smaller interval A is created between a portion of the edge of the end surface 45*a* close to the tip 41 of the ground electrode 40 and the end surface 35*a* of the center electrode 30, it results in quick growth of the flame kernel or quick combustion in the engine. Conversely, when the smaller interval A is created between a portion of the edge of the end surface 45*a* close to the bend 44 of the ground electrode 40 and the end surface 35*a* of the center electrode 30, it results in slow growth of the flame kernel or slow combustion in the engine. In either case, the stability in the location of sparks between the noble metal chips 35 and 45 ensures the stability of combustion velocity, thus resulting in a decreased variation in combustion velocity or growth of flame between combustion cycles.

Figure 7:
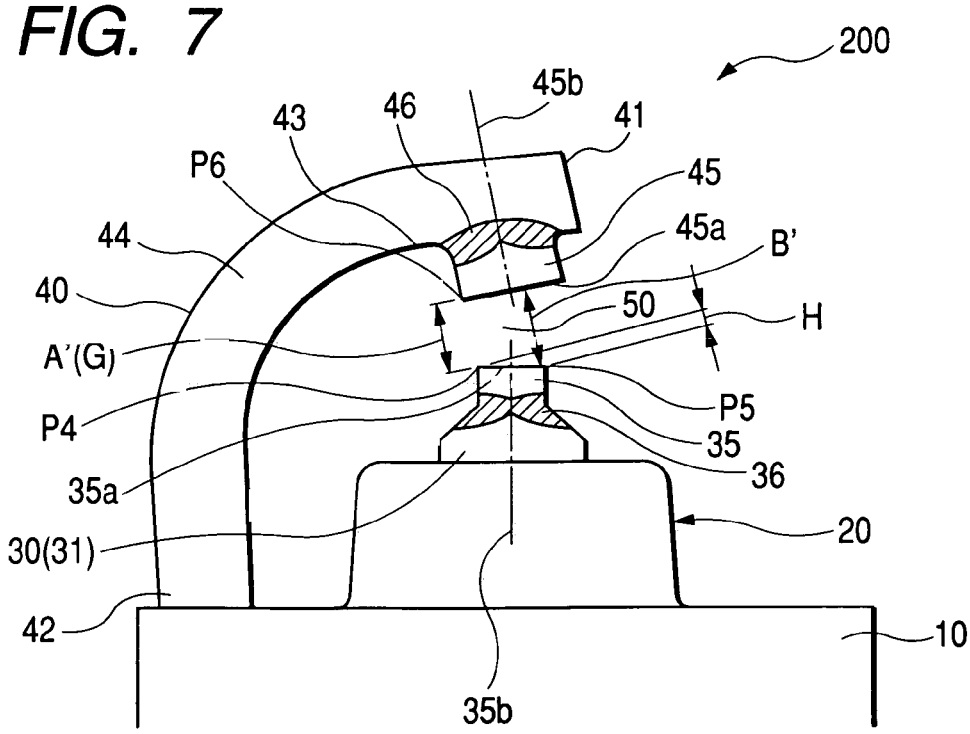
FIG. 7 is a partial side view which shows a spark plug according to the second embodiment of the invention.

FIG. 7 shows a spark plug 200 according to the second embodiment of the invention. The same reference numbers as employed in the first embodiment will refer to the same parts, and explanation thereof in detail will be omitted here.

The noble metal chips 35 and 45 are, like the first embodiment, welded to the tip 31 of the center electrode 30 and the inner side surface 43 of the ground electrode 40 so that they face each other through the spark gap 50.

The diameters T1 and T2 of the noble metal chips 35 and 40 are, like the first embodiment, 1.1 mm or less.

The structure of the spark plug 200 has the feature that a degree of parallelism H between the end surface 35*a* of the noble metal chip 35 of the center electrode 30 and the end surface 45*a* of the noble metal chip 45 of the ground electrode 40 is greater than or equal to 1% of the interval G between the end surfaces 35*a* and 45*a* (i.e., the spark gap 50) and less than 0.15 mm.

The parallelism H is a difference between a minimum distance A' and a maximum distance B' between the end surfaces 3*a* and 45*a* of the noble metal chips 35 and 45. The minimum and maximum distances A' and B' are the shortest and longest intervals between the end surfaces 35*a* and 45*a*, as measured in a direction perpendicular to a reference plane defined to extend over one of the end surfaces 35*a* and 45*a*. In the spark plug 200, as illustrated in FIG. 7, the end surface 45*a* is inclined to a plane extending perpendicular to the longitudinal center line 35*b* of the noble metal chip 35 (i.e., the longitudinal center line C of the spark plug 200) over which the reference plane is defined to measure the parallelism H. The spark gap 50, as referred to herein, is identical with the minimum interval A'.

The basis for the structural feature of the second embodiment will be described below.

We researched the relation between the spark gap 50 and the difference between maximum and minimum intervals between the edges of the end surfaces 35*a* and 45*a* of the noble metal chips 35 and 45 in the structure, as illustrated in FIGS. 3(*a*) and 3(*b*), in which the axis misalignment x is 0.05 mm and found that the difference between the maximum and minimum intervals (i.e., the smaller and greater intervals A and B) is equivalent to 1% of the spark gap 50.

Considering a specific example of the structure in FIGS. 3(*a*) and 3(*b*) in which the noble metal chip 35 of the center electrode 30 has a diameter of 0.6 mm, the noble metal chip 45 of the ground electrode 40 has a diameter of 0.8 mm, the spark gap 50 is 1 mm, and the axis misalignment x is 0.05 mm, the difference between the smaller and greater intervals A and B is 0.01 mm which is equivalent to 1% of the spark gap 50.

A variation in interval between the edges of the end surfaces 35*a* and 45*a* of the noble metal chips 35 and 45 may be created by inclining one of the end surfaces 35*a* and 45*a* to the other as well as by shifting the longitudinal center lines 35*b* and 45*b* of the noble metal chips 35 and 45 laterally, as in the spark plug 100 of the first embodiment.

The fact that the parallelism H between the end surfaces 35*a* and 45*a* of the noble metal chips 35 and 45 is 1% of the spark gap 50 is equivalent to the fact that the difference between the minimum and maximum intervals A' and B' in the structure of FIG. 7 is 1% of the spark gap 50. Specifically, the structure of FIG. 7 provides the same beneficial effects as those in the structure of FIGS. 3(*a*) and 3(*b*) in which the axis misalignment x is 0.05 mm.

The reason that the parallelism H is less than 0.15 mm will be described below.

The above numerical limitation on the parallelism H is based on a general requirement that an increase in the spark gap 50 (i.e., the interval G) arising from spark-caused wear during life cycles of typical spark plugs should be 0.3 mm or less. When such an increase exceeds 0.3 mm, it will result in an increase in discharge voltage required by the spark plugs, which can lead to misfiring.

The fact that the parallelism H is 0.15 mm or less is, as described above, equivalent to the fact that the difference between the minimum and maximum intervals A' and B' between the end surfaces 35*a* and 45*a* of the noble metal chips 35 and 45 is 0.15 mm or less. Conversely, the fact that the parallelism His 0.15 mm or more is equivalent to the fact that the difference between the minimum and maximum intervals A' and B' between the end surfaces 35*a* and 45*a* of the noble metal chips 35 and 45 is 0.15 mm or more.

Specifically, in the spark plug 200 of FIG. 7 in which the parallelism His 0.15 mm or more, the minimum interval A' is created between a portion P4 of the edge of the end surface 35*a* of the noble metal chip 35 and the end surface 45*a* of the noble metal chip 45. The maximum interval B' is created between a portion P5 of the edge of the end surface 35*a* of the noble metal chip 35 and the end surface 45*a* of the noble metal chip 45. The portion P4 is closer to the end surface 45*a* than the portion PS by 0.15 mm or more.

Many sparks will be created between the portion P4 of the edge of the end surface 35*a* of the noble metal chip 35 and a portion P6 of the edge of the end surface 45*a* of the noble metal chip 45 opposed to the portion P4, thus causing the portions P4 and P6 to undergo a greater degree of wear. For instance, when the portion P4 is worn by 0.15 mm, the portion P6 will similarly be worn by 0.15 mm. The interval between the portions P4 and P6 (i.e., the spark gap 50) will, thus, be 0.3 mm.

For the above reason, when the parallelism H between the end surfaces 35*a* and 45*a* of the noble metal chips 35 and 45 is less than 0.15 mm, it meets the requirement that an increase in the spark gap 50 arising from spark-caused wear during life cycles of typical spark plugs should be 0.3 mm or less.

A desired value of the parallelism H between the end surfaces 35*a* and 45*a* of the noble metal chips 35 and 45 may be achieved easily by changing the degree of bending (i.e., curvature) of the middle portion 44 of the ground electrode 40.

The structure of the spark plug 200 ensures the stability in producing sparks between the noble metal chips 35 and 45 at a location (i.e., the portion P6) close to the bend 44 of the ground electrode 40 where a relatively larger amount of thermal energy is withdrawn through the ground electrode 40, so that the temperature of the portion P6 is kept lower than that of a portion of the end surface 45*a* close to the tip 41. This results in a relatively decreased velocity of growth of flame kernel, so that the combustion is developed slowly and stably.

Figure 8:
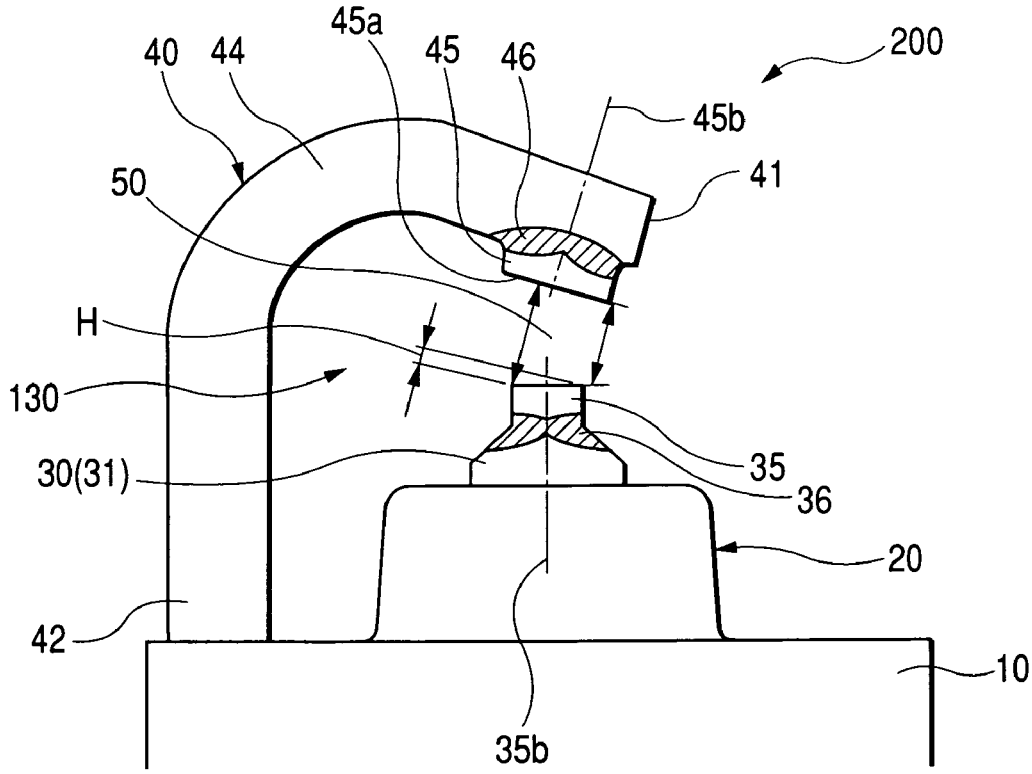
FIG. 8 is a partial side view which shows the first modification of the spark plug of FIG. 7.

FIG. 8 shows a modification of the second embodiment which is different from the one in FIG. 7 in the degree of bending of the ground electrode 40. Other arrangements are identical, and explanation thereof in detail will be omitted here.

The ground electrode 40 is bent to a greater extent than the structure of FIG. 7 to create the shortest distance between a portion of the end surface 45*a* of the noble metal chip 45 close to the tip 41 and the end surface 35*a* of the noble metal chip 35.

Specifically, the degree of curvature of the ground electrode 40 is greater than that in the structure of FIG. 7. This causes the end surface 45*a* of the noble metal chip 45 of the ground electrode 40 to be oriented inwardly, thus resulting in an increased combustion space 130 which is partially closed by the ground electrode 40 and the tip 31 of the center electrode 30. This minimizes the misfiring.

The structure of this modification ensures the stability in producing sparks between the noble metal chips 35 and 45 at a location close to the tip 41 of the ground electrode 40 where a relatively smaller amount of thermal energy is withdrawn through the ground electrode 40, so that the temperature of the edge of the end surface 45*a* close to the tip 41 is kept higher than that of the portion P6 of FIG. 7. This results in a relatively increased velocity of combustion.

Figure 9:
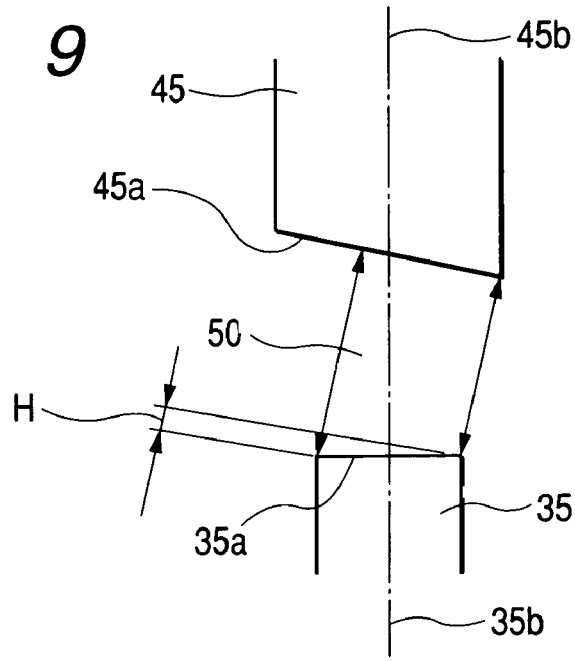
FIG. 9 is a partial side view which shows the second modification of the spark plug of FIG. 7.
Figure 10:
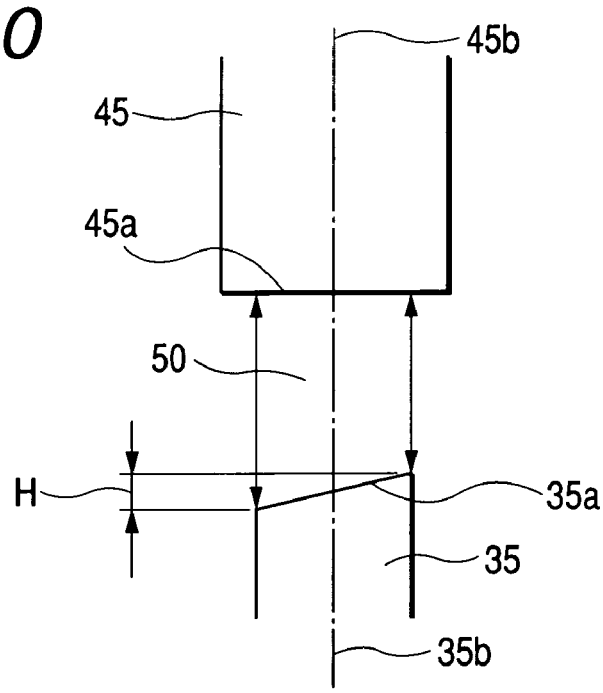
FIG. 10 is a partial side view which shows the third modification of the spark plug of FIG. 7.
Figure 11:
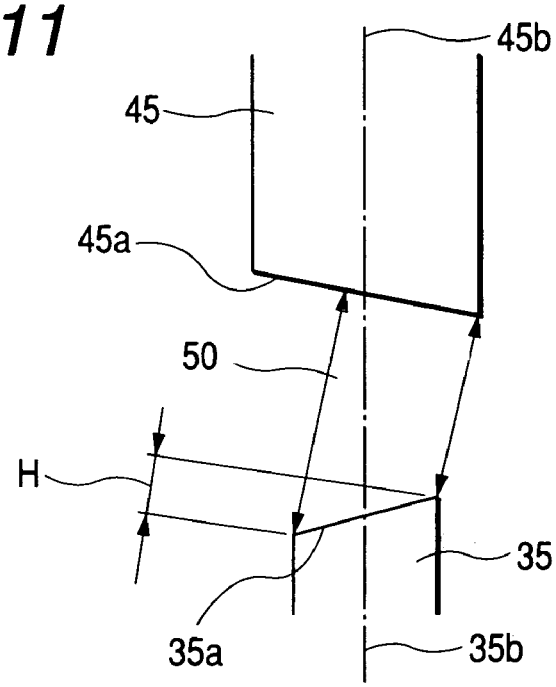
FIG. 11 is a partial side view which shows the fourth modification of the spark plug of FIG. 7.

FIGS. 9, 10, and 11 show second, third, and fourth modifications of the spark plug 200 in which the longitudinal center lines 35*b* and 45*b* of the noble metal chip 35 and 45 of the center and ground electrodes 30 and 40 are aligned with each other, and the parallelism His so selected as to create the shortest interval between portions of the end surfaces 35*a* and 45*a* far away from the bend 44 of the ground electrode 40.

In the second modification of FIG. 9, the end surface 35*a* of the noble metal chip 35 of the center electrode 30 extends perpendicular to the longitudinal center line 35*b*, while the end surface 45*a* of the noble metal chip 45 of the ground electrode 40 is inclined at a given angle (not 90°) to the longitudinal center line 45*b*.

In the third modification of FIG. 10, the end surface 45*a* of the noble metal chip 45 of the ground electrode 40 extends perpendicular to the longitudinal center line 45*b*, while the end surface 35*a* of the noble metal chip 35 of the center electrode 30 is inclined at a given angle (not 90°) to the longitudinal center line 35*b*.

In the fourth modification of FIG. 11, the end surfaces 35*a* and 45*a* of the noble metal chips 35 and 45 are inclined at given angles (not 90°) to the longitudinal center lines 35*b* and 45*b*.

The inclination of the end surfaces 35*a* and 45*a* may be achieved by cutting or grinding the noble metal chips 35 and 45.

In each of the second to fourth modification, the noble metal chip 45 is thicker than the noble metal chip 35, but however, they are identical in diameter with each other. Such a structure is illustrated in FIG. 12 as the fifth modification.

Figure 12:
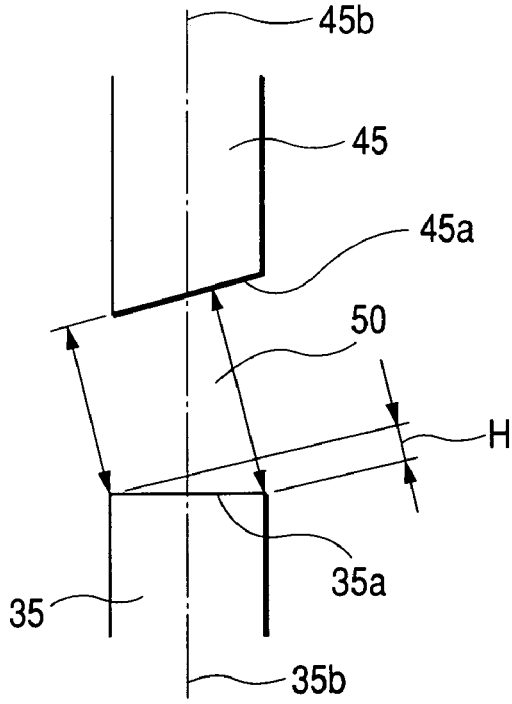
FIG. 12 is a partial side view which shows the fifth modification of the spark plug of FIG. 7.

In FIG. 12, the longitudinal center lines 35*b* and 45*b* of the noble metal chips 35 and 45 are aligned with each other. The noble metal chips 35 and 45 are identical in diameter with each other. The end surface 35*a* of the noble metal chip 35 extends perpendicular to the longitudinal center line 35*b*, while the end surface 45*a* of the noble metal chip 45 is inclined at a given angle (not 90°) to the longitudinal center line 45*b*.

The structures, as illustrated in FIGS. 7 and 8, in which the longitudinal center lines 35*b* and 45*b* extend in misalignment with each other may also have the noble metal chips 35 and 45 which are identical in diameter with each other.

Figure 13:
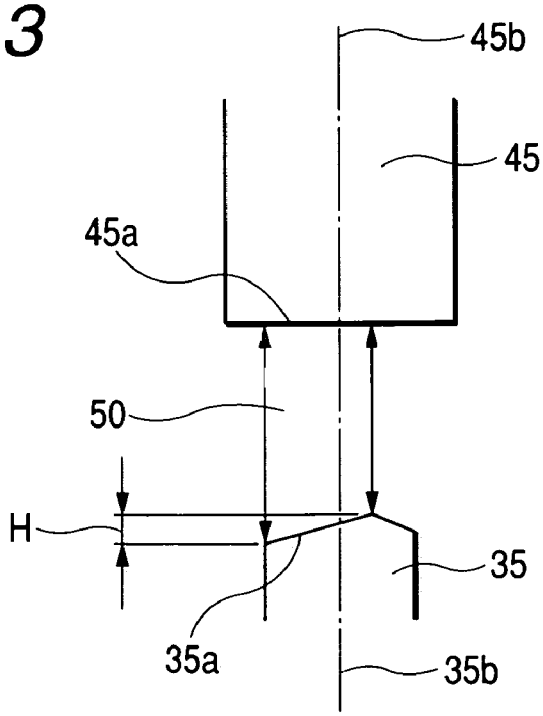
FIG. 13 is a partial side view which shows the sixth modification of the spark plug of FIG. 7.

FIG. 13 shows the sixth modification of the spark plug 200.

The noble metal chip 45 of the ground electrode 40 has the end surface 45*a* extending perpendicular to the longitudinal center line 45*b* thereof. The noble metal chip 35 of the center electrode 30 has the end surface 35*a* made up of two sections which are inclined to the longitudinal center line 35*b* at angles different from each other. The parallelism H between each of the two sections of the end surface 35*a* and the end surface 45*a* is greater than or equal to 1% of the spark gap 50 which is less than 0.15 mm.

Figure 14:
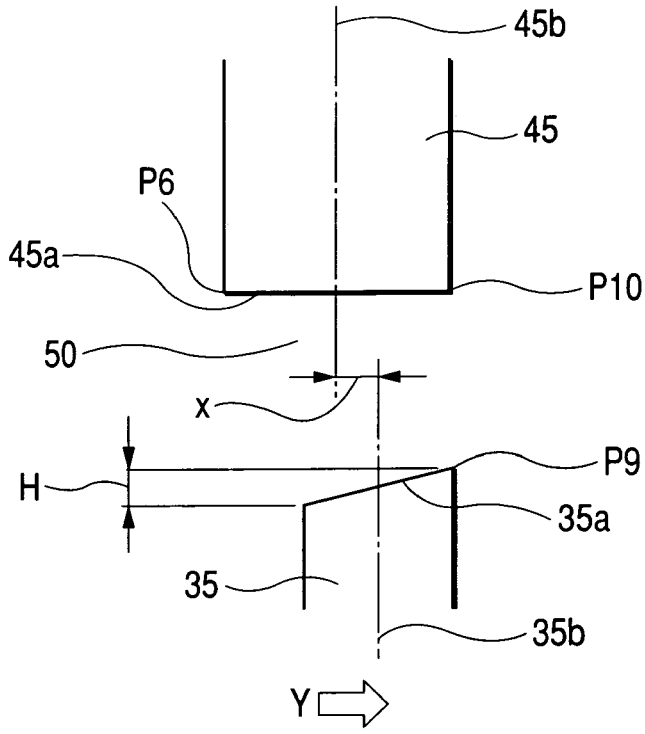
FIG. 14 is a partial side view which shows a spark plug according to the third embodiment of the invention.

FIG. 14 shows a spark plug according to the third embodiment of the invention which is equivalent to a combination of the first and second embodiments.

The end surface 45*a* of the noble metal chip 45 of the ground electrode 40 extends perpendicular to the longitudinal center line 45*b*, while the end surface 35*a* of the noble metal chip 35 of the center electrode 30 is inclined at a given angle (not 90°) to the longitudinal center line 35*b*.

Each of the diameters T1 and T2 of the noble metal chips 35 and 45 is 1.1 mm or less. The longitudinal center lines 35*b* and 45*b* of the noble metal chips 35 and 45 extend parallel to each other, but in misalignment with each other. The axis misalignment x is 0.05 mm or more and less than or equal to the greater of radiuses of the noble metal chips 35 and 45.

The parallelism H between the end surfaces 35*a* and 45*a* is preferably greater than or equal to 1% of the spark gap 50 and less than 0.15 mm.

The structure of this embodiment provides a combination of beneficial effects, as produced by the first and second embodiments, in terms of the stability in the location of sparks created between the end surfaces 35*a* and 45*a* of the noble metal chips 35 and 45, which is suitable for small-sized spark plugs.

The shortest interval is created between the end surface 35*a* of the noble metal chip 35 and a portion P10 of the edge of the end surface 45*a* of the noble metal chip 45 close to the tip 41 (not shown in FIG. 14) of the ground electrode 40, thus ensuring the stability in producing sparks between the noble metal chips 35 and 45 at a location close to the tip 41 of the ground electrode 40 where a relatively smaller amount of thermal energy is withdrawn through the ground electrode 40, so that the temperature of the portion P10 of the end surface 45*a* is kept higher than that of the portion P6 of the end surface 45*a* close to the bend 44 of the ground electrode 40. Specifically, a sequence of sparks are developed between the portions P9 and P10 of the noble metal chips 35 and 45 which are relatively high in temperature. This results in a relatively increased velocity of combustion.

The longitudinal center line 35*b* of the noble metal chip 35 is, as clearly shown in the drawing, shifted toward the portion P10 of the end surface 45*a* of the noble metal chip 45 (i.e., to Y-direction in the drawing) to create the shortest interval between the portions P9 and P10, which exhibits the highest possibility of production of sparks. If the longitudinal center line 35*b* of the noble metal chip 35 is shifted to a direction opposite the Y-direction, portions of the end surfaces 35*a* and 45*a* of the noble metal chips 35 and 45 spaced apart at the shortest interval doe not show the highest possibility of production of sparks. Therefore, the positional relation between the longitudinal center lines 35*b* and 45*b*, as illustrated in FIG. 14, is preferable in terms of the possibility of production of sparks, but however, the structure of this embodiment has substantially the same beneficial effects as those produced by a combination of the first and second embodiments regardless of the direction in which the longitudinal center line 35*a* of the noble metal chip 35 is shifted.

Further, the noble metal chips 35 and 45 may be identical in diameter. The end surface 45*a* may alternatively be inclined to the longitudinal center line 45*b*. The orientation of one of the end surfaces 35*a* and 45*a* to be inclined may be selected from any of the above described structures.

In each of the above embodiments and modifications, the noble metal chip 35 of the center electrode 30 may alternatively be thicker than the noble metal chip 45 of the ground electrode 40.

Figure 15A:
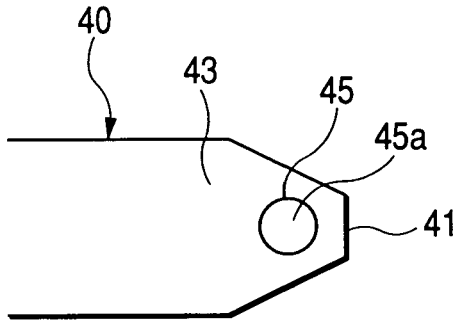
FIG. 15(*a*) is a top view which shows a modified form of a spark plug of the first embodiment.
Figure 15B:
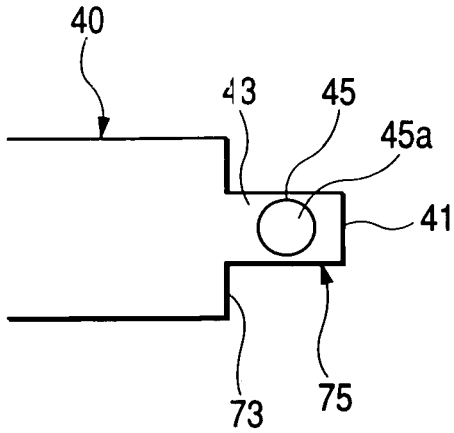

FIGS. 15(*a*) and 15(*b*) show modified forms of the ground electrode 40 which are so shaped as to decrease a thermal stress on the interface or joint between the noble metal chip 45 and the ground electrode 40.

In the form of FIG. 15(*a*), the ground electrode 40 tapers toward the tip 41 thereof. In other words, the ground electrode 40 has the width decreasing gradually to the tip 41 thereof. In the form of FIG. 15(*b*), the ground electrode 40 has a shoulder 73 to form a smaller-width head portion 75 on which the noble metal chip 45 is welded. Such geometries serve to decrease the thermal stress acting on the ground electrode 40, thus minimizing resultant damage to the weld between the noble metal chip 45 and the ground electrode 40.

Figure 16:
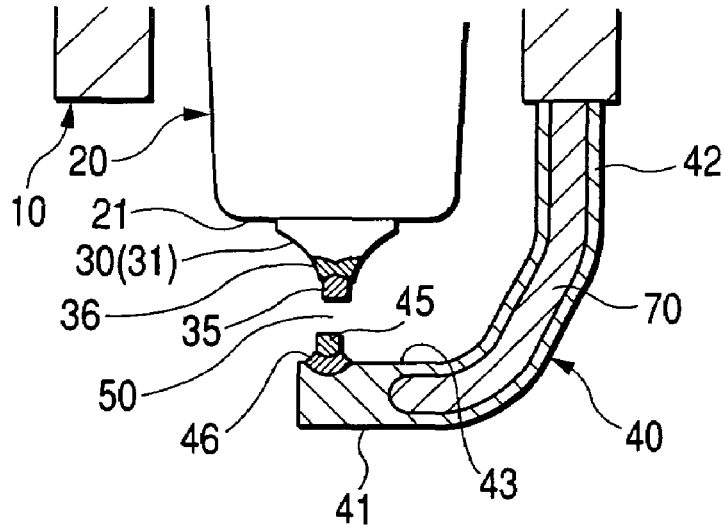
FIG. 16 is a partially sectional view which shows a modification of an internal structure of a ground electrode.
Figure 17:
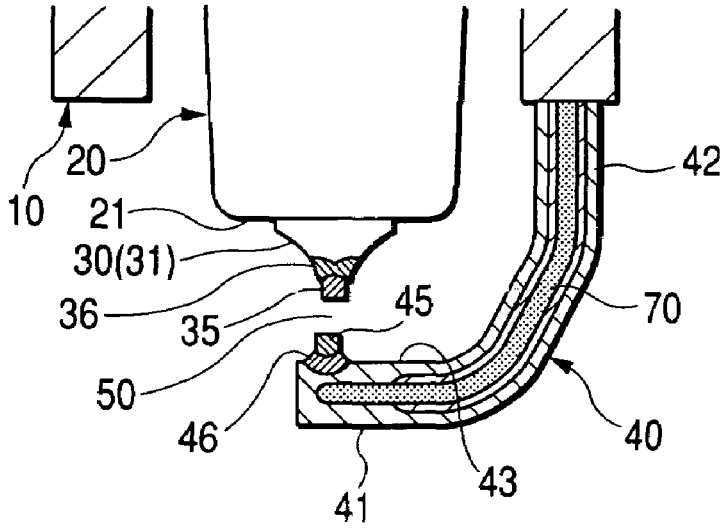
FIG. 17 is a partially sectional view which shows another modification of an internal structure of a ground electrode.

FIGS. 16 and 17 show modified forms of the ground electrode 40 which have an internal structure suitable for decreasing the thermal stress on the interface or joint between the noble metal chip 45 and the ground electrode 40. Specifically, the ground electrode 40 in each of FIGS. 16 and 17 has a core member 70 which is greater in thermal conductivity than the base material (e.g., Ni alloy) thereof, thereby enhancing a decrease in temperature of the interface between the noble metal chip 45 and the ground electrode 40.

The core member 70 of FIG. 16 is formed by a single layer made of Cu. The core member 70 of FIG. 17 is formed by a laminate of a Cu-layer and a Ni-layer (e.g., a Ni-clad).

Figure 18A:
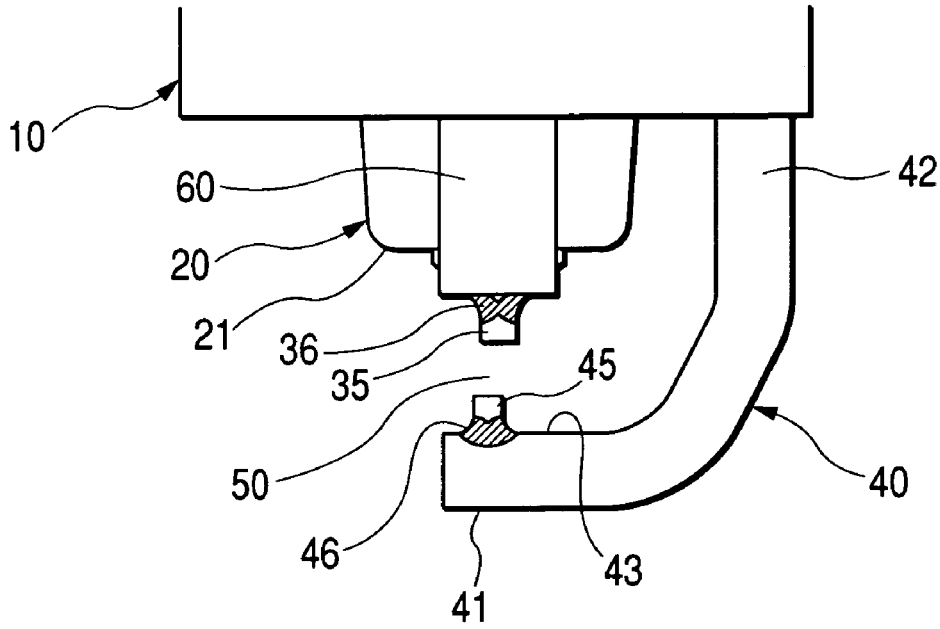
FIG. 18(*a*) is a partially side illustration which shows a modification of a spark plug with additional ground electrodes.
Figure 18B:
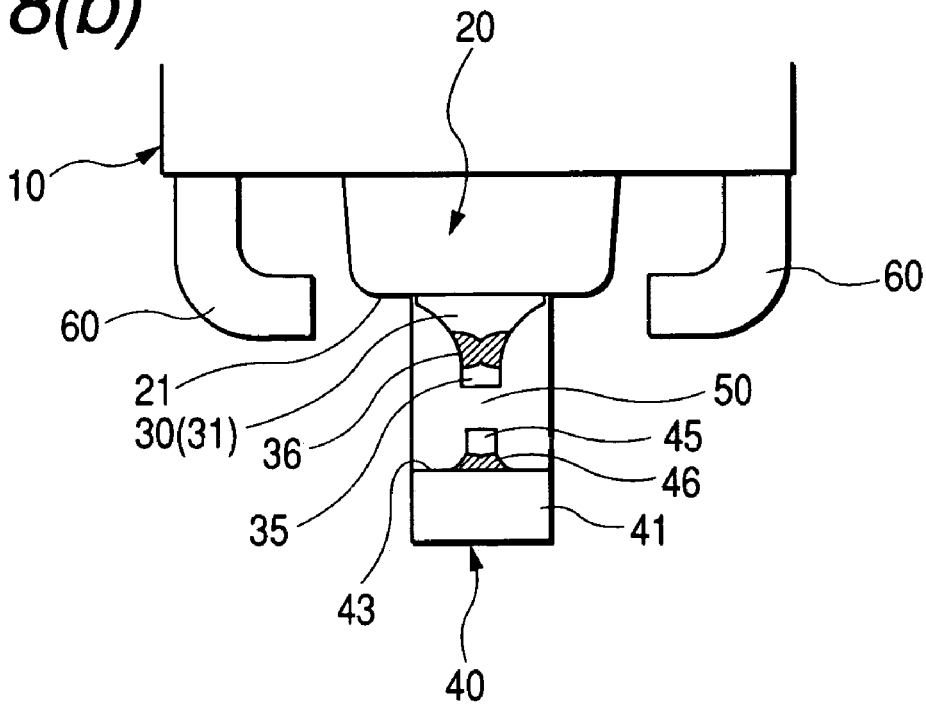

FIGS. 18(*a*) and 18(*b*) show a modified form of the spark plug 100 or 200 which also includes additional sub-electrodes 60 welded to the metal shell 10. The sub-electrodes 60 are, as clearly shown in FIG. 18(*b*), opposed diametrically to each other across the tip 21 of the porcelain insulator 20 and work to burn out carbon adhered to the surface of the porcelain insulator 20 arising from smoldering of the spark plug 100. The user of the sub-electrodes 60, thus, results in an improved resistance to the smoldering of the spark plug 100 or 200.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A spark plug as comprising:

a metal shell;

a center electrode disposed within said metal shell with a top projecting from said metal shell, the top having a ground electrode-facing portion on which a cylindrical member is joined; and a ground electrode having a first end portion and a second end portion oposed to the first end portion, the first end portion being joined to said metal shell, the second end portion having a center electrode-facing portion to which a cylindrical member is joined, wherein the cylindrical member of said center electrode extends toward the center electrode-facing portion of said ground electrode to have an end surface facing the center electrode-facing portion, and the cylindrical member of said around electrode extends toward the ground electrode-facing portion of said center electrode to have an end surface facing the end surface of the cylindrical member of said center electrode through a spark gap, wherein diameters of the cylindrical members of said center and ground electrodes are 1.1 mm or less, wherein a longitudinal center line of the cylindrical member of said center electrode extends parallel to a longitudinal center line of the cylindrical member of said ground electrode in misalignment with each other, and an amount of misalignment between the longitudinal center lines of the cylindrical members is 0.05 mm or more and less than or equal to a greater of radiuses of the cylindrical members, wherein a degree of parallelism between the end surfaces of the cylindrical members of said center and ground electrodes is greater than or equal to 1% of the spark gap and less than 1.15mm, and wherein a shortest distance between the end surface of the cylindrical member of said ground electrode and the cylindrical member of said center electrode is between a portion of an edge of the end surface of the cylindrical member of said ground electrode closest to a tip of the second end portion of the ground electrode and the end surface of the cylindrical member of the center electrode.

2. A spark plug as set forth in claim 1, wherein one of the longitudinal center lines of the cylindrical members of said center and ground electrodes are shifted to the other in a direction in which portions of the end surfaces of the cylindrical members of the center and ground electrodes located apart from each other at the shortest interval exhibits the highest possibility of production of sparks therebetween.

3. A spark plug as set forth in claim 1, wherein said ground electrode is made of a bar member which has a middle portion between the first and second end portions, the middle portion being bent to have the second end portion extend over the top of said center electrode.

4. A spark plug as set forth in claim 1, wherein the cylindrical members of said center and ground electrodes are implemented by noble metal chips welded to materials of said center and ground electrodes, respectively.

5. A spark plug as set forth in claim 4, wherein each of the noble metal chips of said center electrode and said ground electrode is made of one of an Ir alloy containing 50 Wt % or more of Ir and a Pt alloy containing 50 Wt % of Pt.

6. A spark plug as set forth in claim 4, wherein each of the noble metal chips of said center electrode and said ground electrode is made of a material containing, as an additive, one of Ir, Pt, Rh, Ni, W, Pd, Ru, Os, Al, Y, and $Y_2O_3$.

7. A spark plug as set forth in claim 1, wherein the cylindrical members of said center and ground electrodes are different in diameter from each other.

8. A spark plug comprising:

a metal shell;

a center electrode disposed within said metal shell with a top projecting from said metal shell, the top having a ground electrode-facing portion on which a cylindrical member is joined; and a ground electrode having a first end portion and a second end portion opposed to the first end portion, the first end portion being joined to said metal shell, the second end portion having a center electrode-facing portion to which a cylindrical member is joined, wherein the cylindrical member of said center electrode extends toward the center electrode-facing portion of said ground electrode to have an end surface facing the center electrode-facing portion, and the cylindrical member of said ground electrode extends toward the ground electrode-facing portion of said center electrode to have an end surface facing the end surface of the cylindrical member of said center electrode through a spark gap, wherein diameters of the cylindrical members of said center and ground electrodes are 1.1 mm or less, wherein a degree of parallelism between the end surfaces of the cylindrical members of said center and ground electrodes is greater than or equal to 1% of the spark gap and less than 0.15 mm, and wherein a shortest distance between the end surface of the cylindrical member of said group electrode and the cylindrical member of said center electrode is between a portion of an edge of the end surface of the cylindrical member of said ground electrode closest to a tip of the second end portion of the ground electrode and the end surface of the cylindrical member of the center electrode.

9. A spark plug as set forth in claim 8, wherein a longitudinal center line of the cylindrical member of said center electrode extends parallel to a longitudinal center line of the cylindrical member of said ground electrode.

10. A spark plug as set forth in claim 8, wherein a longitudinal center line of the cylindrical member of said center electrode extends unparallel to a longitudinal center line of the cylindrical member of said ground electrode.

11. A spark plug as set forth in claim 8, wherein said ground electrode is made of a bar member which has a middle portion between the first and second end portions, the middle portion being bent to have the second end portion extend over the top of said center electrode so that an interval between a portion of the end surface of the cylindrical member of said ground electrode close to a tip of the second end portion and the end surface of said center electrode is smaller than an interval between a portion of the end surface of the cylindrical member of said ground electrode close to the middle portion and the end surface of said center electrode.

12. A spark plug as set forth in claim 8, wherein the cylindrical members of said center and ground electrodes are implemented by noble metal chips welded to materials of said center and ground electrodes, respectively.

13. A spark plug as set forth in claim 12, wherein each of the noble metal chips of said center electrode and said ground electrode is made of one of an Ir alloy containing 50 Wt % or more of Ir and a Pt alloy containing 50 Wt % of Pt.

14. A spark plug as set forth in claim 12, wherein each of the noble metal chips of said center electrode and said ground electrode is made of a material containing, as an additive, one of Ir, Pt, Rh, Ni, W, Pd, Ru, Os, Al, Y, and $Y_2O_3$.

15. A spark plug as set forth in claim 8, wherein the cylindrical members of said center and ground electrodes are different in diameter from each other.

* * * * *